US008511331B2

(12) United States Patent
Nakashima et al.

(10) Patent No.: US 8,511,331 B2
(45) Date of Patent: Aug. 20, 2013

(54) PROCESS LIQUID FEED MECHANISM

(75) Inventors: Tsunenaga Nakashima, Koshi (JP); Shunsuke Shiraishi, Koshi (JP); Toshihide Takeo, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 165 days.

(21) Appl. No.: 13/094,390

(22) Filed: Apr. 26, 2011

(65) Prior Publication Data

US 2011/0265896 A1 Nov. 3, 2011

(30) Foreign Application Priority Data

Apr. 28, 2010 (JP) ..... 2010-104519

(51) Int. Cl.
*F04F 1/00* (2006.01)

(52) U.S. Cl.
USPC ..... 137/212; 137/588

(58) Field of Classification Search
USPC ..... 137/212, 588; 285/124.1, 305
See application file for complete search history.

(56) References Cited

U.S. PATENT DOCUMENTS

| | | | | | |
|---|---|---|---|---|---|
| 943,421 | A * | 12/1909 | Kleinfeldt | 222/396 |
| 2,139,476 | A * | 12/1938 | Townsend | 137/261 |
| 2,413,438 | A * | 12/1946 | Doose | 222/539 |
| 2,491,406 | A * | 12/1949 | Zeeb | 285/89 |
| 3,427,552 | A * | 2/1969 | Sauer et al. | 439/332 |
| 3,714,967 | A * | 2/1973 | Zupan et al. | 137/588 |
| 3,718,165 | A * | 2/1973 | Grothoff | 141/20 |
| 3,842,870 | A * | 10/1974 | Burgess | 141/286 |
| 3,971,614 | A * | 7/1976 | Paoli et al. | 439/321 |
| 4,068,681 | A * | 1/1978 | McNair et al. | 137/588 |
| 4,376,451 | A * | 3/1983 | Bouron et al. | 137/588 |
| 5,335,821 | A * | 8/1994 | Osgar | 222/83 |
| 5,498,043 | A * | 3/1996 | Goldenberg | 285/242 |
| 7,296,590 | B2 * | 11/2007 | Kitagawa | 137/399 |
| 7,497,484 | B2 * | 3/2009 | Ziman | 285/402 |
| 7,571,937 | B2 * | 8/2009 | Patel | 285/92 |
| 7,971,606 | B2 * | 7/2011 | Cho et al. | 137/588 |
| 2005/0087237 | A1 * | 4/2005 | O'Dougherty et al. | 137/590 |
| 2009/0218813 | A1 * | 9/2009 | Helstern | 285/355 |
| 2011/0169258 | A1 * | 7/2011 | Nowak et al. | 285/18 |

FOREIGN PATENT DOCUMENTS

| | | |
|---|---|---|
| JP | 6-031103 B2 | 4/1994 |
| JP | 2008-006325 A | 1/2008 |

* cited by examiner

*Primary Examiner* — John Rivell
*Assistant Examiner* — Umashankar Venkatesan
(74) *Attorney, Agent, or Firm* — Nath, Goldberg & Meyer; Jerald L. Meyer

(57) ABSTRACT

A process liquid feed mechanism includes a fixed cylinder with a thread around a peripheral surface, a movable cylinder provided coaxially with the fixed cylinder, a process liquid feed tube and an operating rotator. The movable cylinder is screw-engaged to the fixed cylinder. The process liquid feed tube is fixed in an axial position relative to the movable cylinder and passes through the lid and a cylinder including the fixed cylinder and the movable cylinder to be axially movable relative to the cylinder. The operating rotator includes an annular portion provided coaxially with the movable cylinder. An engaging portion and an engaged portion, which are provided in the movable cylinder and the annular portion respectively, rotate the movable cylinder through engagement therebetween with rotation of the operating rotator and release the engagement as a torque on the movable cylinder increases.

9 Claims, 19 Drawing Sheets

PROCESS LIQUID FEED MECHANISM

CROSS-REFERENCE TO RELATED APPLICATIONS

This application is based upon and claims the benefit of priority from Japanese Patent Application No. 2010-104519, filed on Apr. 28, 2010, the entire contents of which are incorporated herein by reference.

TECHNICAL FIELD

The present disclosure relates to a process liquid feed mechanism for use with a container body which stores a process liquid such as a resist and pressure-sends the process liquid by means of a pressurizing gas.

BACKGROUND

In a photolithography process of a manufacture process for a semiconductor device, various process liquids such as a resist are fed to a substrate such as a semiconductor wafer (hereinafter, simply referred to as a wafer).

Referring to FIG. 15, a liquid bottle 101 storing a resist 101 is provided with a resist feed mechanism 102 that is attachable to and detachable from the liquid bottle 101. The resist feed mechanism 102 includes a bottle cap 104 for closing an opening 103 of the liquid bottle 101. A pressurizing gas such as a nitrogen ($N_2$) gas is fed into the liquid bottle 101 through a pressurizing gas feed tube 105 provided in the bottle cap 104. As a result, the resist 110 flows into a process liquid feed tube 106 with a lower end thereof submerged below a liquid surface and then is pressure-sent to the wafer. If the resist is exhausted and decreases, the liquid bottle 101 is replaced.

A lock mechanism 107 for fixing a height position of the process liquid feed tube 106 is provided on an underside of the bottle cap 104. The lock mechanism 107 is a ring-shaped member with a thread around its periphery. The lock mechanism 107 is configured to increase friction between its inner periphery and the process liquid feed tube 106 as being fastened to the bottle cap 104, thus anchoring the process liquid feed tube 106 to the bottle cap 104.

In general, the resist 110 is expensive. Thus, it is preferred that the liquid bottle 101 is replaced after the resist 110 in the liquid bottle 101 is fully used. Further, to this end, it is necessary to adjust the height position of the process liquid feed tube 106 such that the lower end of the process liquid feed tube 106 is placed in contact with a bottom surface of the liquid bottle 101. In this regard, the bottle cap 104 may be attached to the liquid bottle 101 through the following procedures.

First, the resist feed mechanism 102 is attached to the liquid bottle 101 as locking caused by the lock mechanism 107 is released. The height of the process liquid feed tube 106 is adjusted in order to find a position where the lower end of the process liquid feed tube 106 abuts against the bottom surface of the liquid bottle 101. Subsequently, the bottle cap 104 is removed from the liquid bottle 101 such that the process liquid feed tube 106 and the bottle cap 104 are not shifted relative to each other. Thereafter, the process liquid feed tube 106 is locked to the bottle cap 104 by means of the lock mechanism 107. After locking, the bottle cap 104 is attached to the liquid bottle 101 again.

However, the experience or skill of the operator, who carries out the replacement task, may influence whether the relative position between the process liquid feed tube 106 and the bottle cap 104 can be maintained accurately until the height position of the process liquid feed tube 106 is found and then locked into position. Furthermore, to prevent the deterioration of the resist 110 within a process atmosphere of a clean room where the liquid bottle 101 is situated, the liquid bottle 101 includes a lightproof member. Thus, it is impossible to visibly identify the position of the lower end of the process liquid feed tube 106 in the liquid bottle 101 outside the liquid bottle 101. As a result, although the operator locks the process liquid feed tube 106 through the aforesaid procedures, the lower end of the process liquid feed tube 106 may be spaced apart from the bottom surface of the liquid bottle 101 in practice. Thus, some of the resist 110 may remain in the liquid bottle 101 (i.e. due to the space between the lower end of the process liquid feed tube 106 and the bottom surface of the liquid bottle 101).

Further, the liquid bottle 101 may include a highly transparent member depending on the type of process liquid being used. However, the process liquid may be lightproof, and in such a case, it is impossible to identify the position of the lower end of the process liquid feed tube 106 outside the liquid bottle 101. Therefore, the lower end of the process liquid feed tube 106 may spaced apart from the bottom surface of the liquid bottle 101.

According to the resist feed mechanism 102 shown in FIG. 15, the lock mechanism 107 performs a locking action at the underside of the bottle cap 104. However, by way of another example, the lock mechanism may be configured to perform the locking action on top of the bottle cap 104. In such a case, the locking action can be performed as the bottle cap 104 is attached to the container body 101. However, this is problematic in that screw-fastening of the lock mechanism 107 may shift the position of the process liquid feed tube 106 downwardly and a lower end portion of the process liquid feed tube 106 may be bent using such a process. Accordingly, the operator needs to perform the locking task while raising the process liquid feed tube 106 to the extent that the positional shift is caused by the screw-engagement. However, this may also lead to leaving some of the process liquid remaining in the container body 101 since properly positioning the liquid feed tube 106 varies depending upon the experiences or skills of each operator.

Moreover, the liquid bottle 101 has various shapes and thus the positional adjustment of the process liquid feed tube 106 as explained above must be made whenever replacing the liquid bottle 101, but this is burdensome. Japanese Laid-open Patent Publication No. 2008-6325 suggests one example of the above-explained process for liquid feed mechanisms. However, this reference is silent as to the afore-mentioned problems and the mechanism suggested therein cannot solve the problems. Further, Japanese Laid-open Patent Publication No. (Sho) 60-251047 suggests a structure of a handle cap. However, the handle cap suggested in this reference is used for a gasoline tank. The handle cap is irrelevant to the present disclosure and cannot solve the afore-mentioned problems.

SUMMARY

Embodiments of the present disclosure have been made in light of the foregoing. In some embodiments, a process liquid feed mechanism capable of preventing a process liquid from remaining within a container body is provided.

The present disclosure provides numerous embodiments of a process liquid feed mechanism. In one exemplary embodiment, by way of non-limiting example, the process liquid feed mechanism pressure-sends a process liquid stored in a lightproof container using a pressurizing gas. The container includes a container body and a lid closing a top opening of the container body. The process liquid feed mechanism includes the following: a fixed cylinder with a thread formed on a peripheral surface, the fixed cylinder projecting from the lid upwardly of the container body; a movable cylinder provided coaxially with the fixed cylinder and screw-engaged to an inside or outside of the fixed cylinder; a process liquid feed tube passing through the lid and a cylinder including the fixed cylinder and the movable cylinder so as to be axially movable relative to the cylinder, the process liquid feed tube being fixed in an axial position relative to the movable cylinder; an operating rotator including an annular portion provided coaxially with the movable cylinder; and an engaging portion and an engaged portion provided in the movable cylinder and the annular portion respectively, the engaging portion and the engaged portion being configured to rotate the movable cylinder through engagement therebetween when the operating rotator is rotated and to release the engagement therebetween as torque applied to the movable cylinder increases. When a rotation of the operating rotator brings a lower end of the process liquid feed tube into abutment with a bottom of the container body, the engaging portion and the engaged portion release the engagement therebetween, thus idling the operating rotator.

The process liquid may be lightproof instead of the lightproof container, which falls within the scope of the present disclosure. Particular embodiments disclosed in the present disclosure may be as follows.

In one embodiment, the fixed cylinder is located inside the movable cylinder.

In another embodiment, the annular portion is provided outside the movable cylinder to encircle the movable cylinder.

In yet another embodiment, a feed passage for the pressurizing gas separated from a flow passage for the process liquid is provided in the process liquid feed tube.

DETAILED DESCRIPTION

Figure 1:
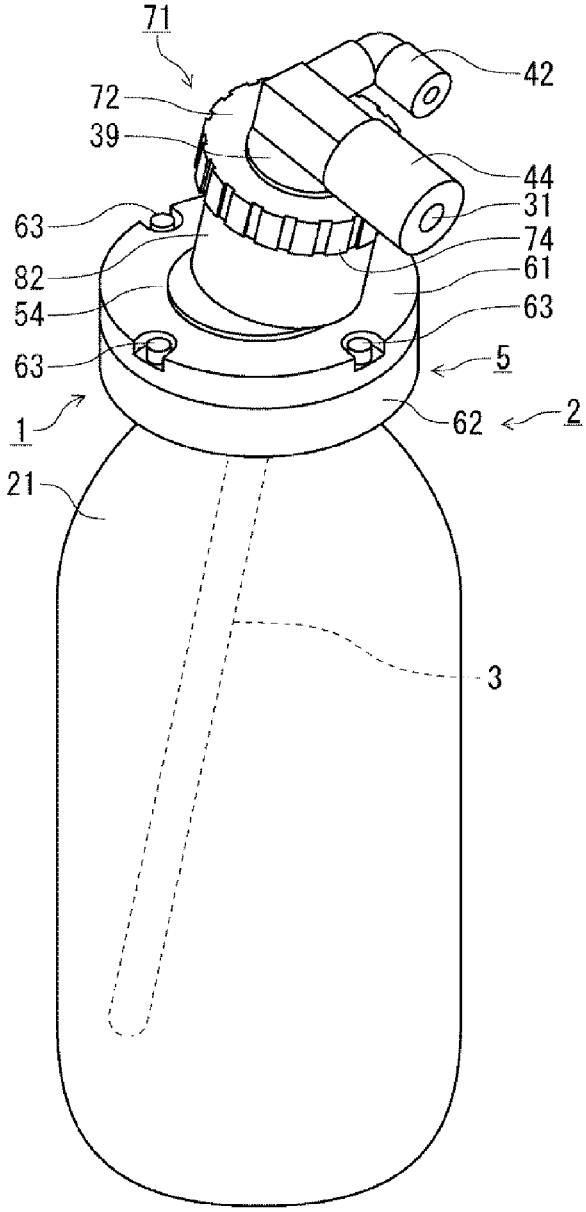
FIG. 1 is a perspective view of a pressurized resist feed container including a resist feed mechanism in accordance with an embodiment of the present disclosure.
Figure 2:
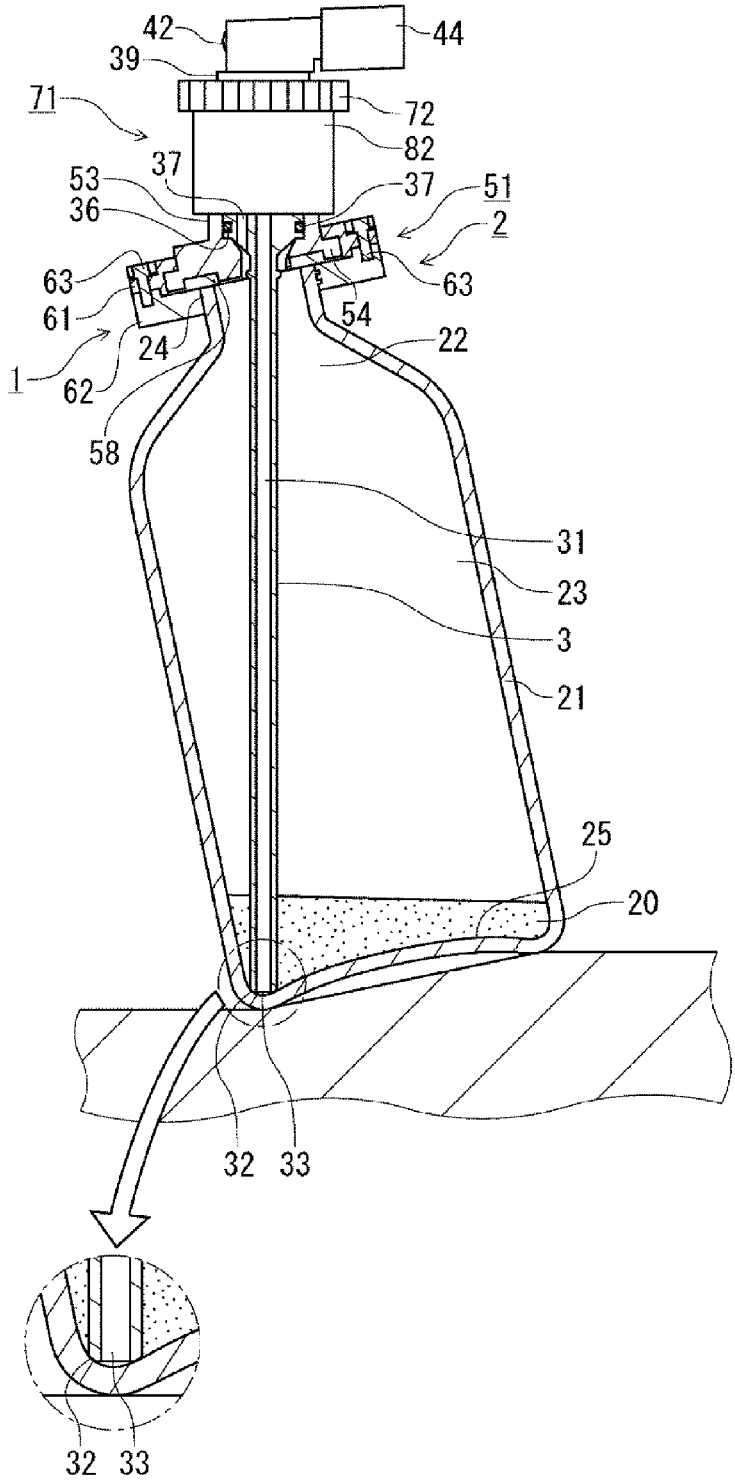
FIG. 2 is a longitudinally-sectional side view of the pressurized resist feed container.

Descriptions will be provided as to a pressurized resist feed container 2 including a resist feed mechanism 1 according to one embodiment of the present disclosure with reference to a perspective view shown in FIG. 1 and a longitudinally-sectional side view shown in FIG. 2. The pressurized resist feed container 2 comprises a liquid bottle 21 (container body) and the resist feed mechanism 1. The resist feed mechanism 1 is configured to be attachable to and detachable from the liquid bottle 2.

The resist feed mechanism 1 includes a resist feed tube 3 (process liquid feed tube) and a bottle cap 5. A resist 20 (process liquid) is stored in the liquid bottle 21. The resist feed tube 3 feeds the resist 20 from the liquid bottle 21 to a wafer located externally. The bottle cap 5 serves to adjust and fix the vertical position of the resist feed tube 3 such that a lower end of the resist feed tube 3 is in abutment with a bottom surface of the liquid bottle 21.

An opening 22 is provided at an upper portion of the liquid bottle 21. A storage space 23 connected to the opening 22 is configured to be narrow toward the opening 22 in its upper section. A side wall encircling the opening 22 extends upward. An outer periphery 24 of the side wall is formed with a thread. A middle section of the bottom surface 25 of the liquid bottle 21 arcs upward such that the resist 20 flows toward the periphery of the bottom surface 25 due to gravity. The liquid bottle 21 includes a lightproof container in order to prevent deterioration of the resist 20.

In some embodiments, the liquid bottle 21 is made lightproof by being shaded in a process atmosphere where the liquid bottle 21 is situated. This shading hides the resist feed tube 3 so that it cannot be seen when viewed outside the liquid bottle 21 in said process atmosphere. The liquid bottle 21 is installed in a predetermined location in a clean room such that the resist feed tube 3 is vertically oriented.

The resist feed tube 3 is bent at an upper portion to form an inverted L shape when viewed from the side. A resist flow passage 31 extends from one end of the resist feed tube 3 toward the opposite end thereof As shown in a portion encircled by a dotted line in FIG. 2, a side wall 32 of the lower end of the resist feed tube 3 is inclined inwardly in conformity with the contour of the bottom surface 25 of the liquid bottle 21. This renders an opening 33 in the lower end of the resist feed tube 3 closer to the bottom surface 25, thus more securely preventing the resist 20 from remaining in the liquid bottle 21.

Figure 3:
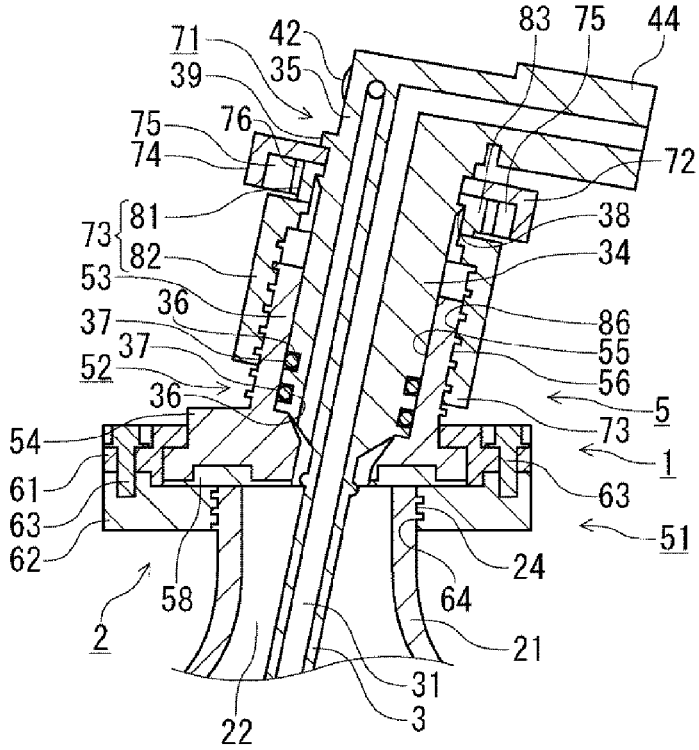
FIG. 3 is a longitudinally-sectional side view of the resist feed mechanism constituting the pressurized resist feed container.

An outer diameter of the upper portion of the resist feed tube 3 is greater than an outer diameter of the lower portion. The upper portion comprises an enlarged diameter portion 34. Descriptions will be continued with further reference to a longitudinally-sectional side view of the enlarged diameter portion 34 shown in FIG. 3. The enlarged diameter portion 34 is formed with a flow passage 35 for a $N_2$ gas (pressurizing gas) that extends from above downwardly parallel with the resist flow passage 31 and then is open in a lower end of the enlarged diameter portion 34. The resist flow passage 31 and the $N_2$ gas flow passage are separated from each other.

Figure 4:
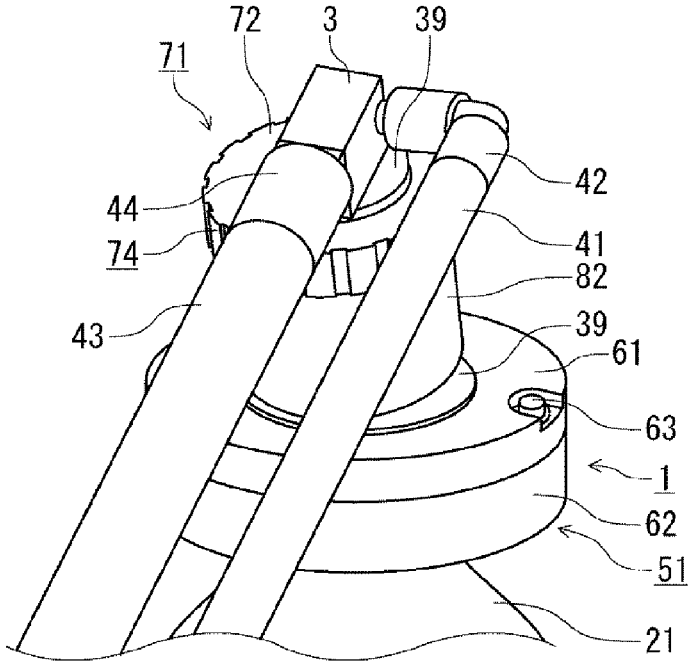
FIG. 4 is a perspective view of the resist feed mechanism.

Grooves 36, 36 are formed around an outer periphery of the enlarged diameter portion 34 at a vertical interval. An O-ring 37 is inlaid to each groove 36, 36. Further, flanges 38, 39 are formed at a vertical interval above the grooves 36, 36. As shown in FIG. 4, a feed port 42 for connection to a $N_2$ gas feed pipe 41 is provided above the flanges 38, 39. The $N_2$ gas feed pipe 41 is connected to a $N_2$ gas supply source 19 (this will be described below) at an upstream portion. The $N_2$ gas fed from the supply source is fed to the $N_2$ gas flow passage 35 through the feed port 42 and then fed from the $N_2$ gas flow passage 35 to the opening 22, thus pressurizing an interior of the liquid bottle 21.

Further, an upstream portion of the resist feed tube 3 includes a connection port 44 for connection to a pipe 43. As the interior of the liquid bottle 21 is pressurized by the $N_2$ gas, the resist 20 flows into the pipe 43 through the resist flow passage 31 and then is fed to a pump. The pump controls the downstream feed amount of the resist and feeds the resist to a wafer W. In this embodiment, the resist feed tube 3 is configured such that the $N_2$ gas feed pipe 42 and the pipe 43 extend at the same height in the same direction. Thus, by integrating the pipes 41, 43 and thus increasing the strength of the pipes 41, 43, the pipes 41, 43 can be prevented from being bent.

The resist feed tube 3 is configured to have a thickness to allow the resist feed tube not to be bent when the resist feed tube is brought into abutment with the bottom surface 25 of the liquid bottle 21 when the vertical position of the resist feed tube 3 is being adjusted as described below. The resist feed tube 3 may be made from a material such as PTFE (polytetrafluoroethylene), PFA (tetrafluoroethylene-perfluoroalkyl vinyl ether copolymer), etc.

Figure 5:
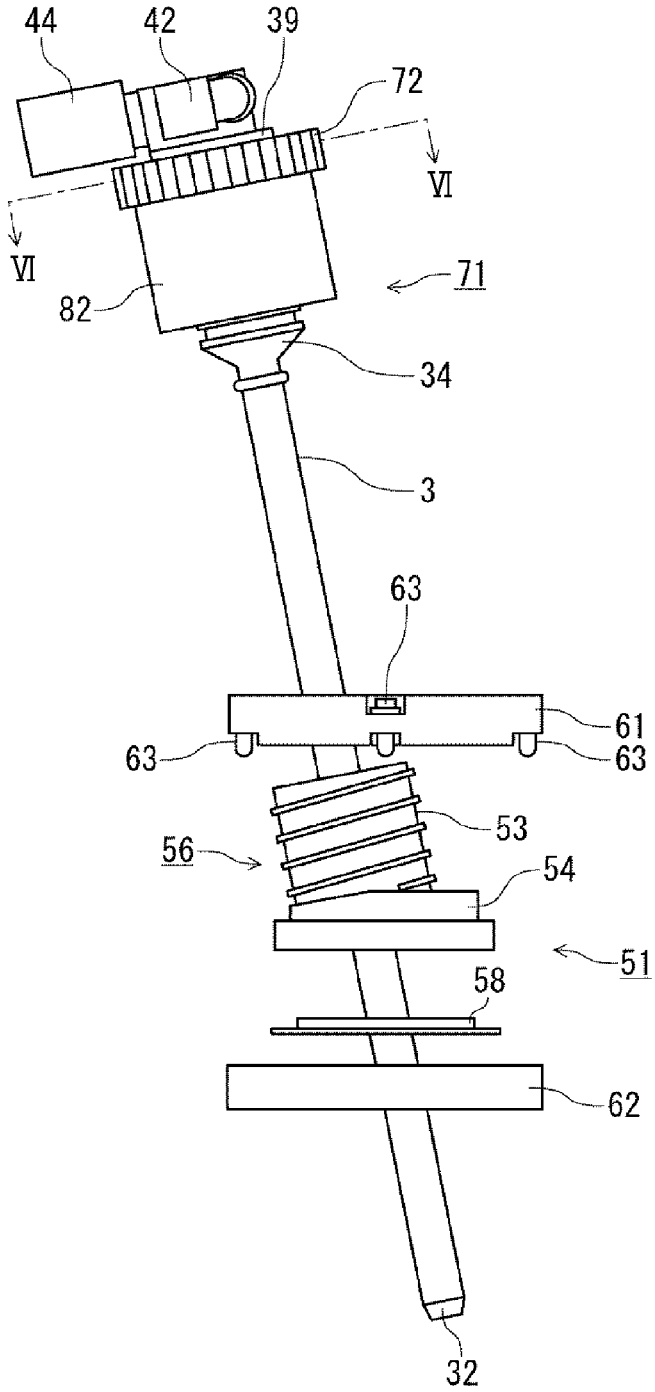
FIG. 5 is an exploded view of the resist feed mechanism.

Next, the bottle cap 5 will be described with further reference to FIG. 5 showing an exploded view of the bottle cap. The bottle cap 5 includes a lower cap 51 and an upper cap 71. The upper cap 71 is configured to be a fixed distance away from the resist feed tube 3 and to be freely changeable in its vertical position relative to the lower cap 51. Thus, if the vertical position of the upper cap 71 relative to the lower cap 51 is changed, then the vertical position of the resist feed tube 3 relative to the lower cap 51 is also changed.

The lower cap 51 includes a cap body 51 forming a lid for closing the opening 22 of the liquid bottle 21, an upper ring 61 and a lower ring 62. The upper ring 61 and the lower ring 62 serve to anchor the cap body 52 to the liquid bottle 21. The cap body 52 includes an inner cylinder 53 having a cylindrical shape opened vertically. A lower portion of the inner cylinder 53 (fixed cylinder) forms a ring-shaped supporter 54 expanding outwardly and inwardly. The supporter 54 has an outer diameter greater than the outer diameter of the inner cylinder 53 and an inner diameter smaller than the inner diameter of the inner cylinder 53.

An inner peripheral surface 55 of the inner cylinder 53 encircles the enlarged diameter portion 34 of the resist feed tube 3 and guides the enlarged cylinder 53 in an axial direction of the inner cylinder 53 when adjusting the height of the resist feed tube 3. Thus, the lower end of the resist feed tube 3 can be brought into abutment with the peripheral edge of the bottom surface 25 of the liquid bottle 21. The O-rings 37, 37 seal up the gap between the inner peripheral surface 55 and the enlarged diameter portion 34. Further, the resist feed tube 3 is rotatable about the axis of the inner cylinder 53. A thread is formed on outer periphery 56 of the inner cylinder 53.

A sealing member 58 is provided beneath the supporter 54. The sealing member 58 is ring shaped. A portion of the sealing member 58 abutting against the liquid bottle 21 is thick. When the bottle cap 5 is attached to the liquid bottle 21, an underside of the supporter 54 is placed in close abutment with an upper edge of the liquid bottle 21 via the sealing member 58, thus sealing up the gap between the supporter 54 and the liquid bottle 21 and maintaining the interior of the liquid bottle airtight. By way of example, an O-ring, a gasket, a packing and the like may be used as the sealing member 58.

An inner edge of the upper ring 61 and an inner edge of the lower ring 62 are configured to pinch an outer edge of the sealing member 58 and an outer edge of the supporter 54 from above and below respectively. The inner edge of the upper ring 61 and the inner edge of the lower ring 62 are anchored to each other by fasteners 63. A thread is formed on an inner periphery of the lower ring 62. Said thread and the thread formed in the outer periphery 24 of the opening 22 of the liquid bottle 21 are screw-engaged to each other, thus anchoring the bottle cap 5 to the liquid bottle 21.

The liquid bottle 21 may have various capacities, for example, 3.79 L, 0.95 L or 1 L. The opening 22 of the liquid bottle 21 may also have various sizes depending on the capacity of the liquid bottle 21. The upper ring 61 and the lower ring 62 may be also suitably designed depending upon the sizes of the opening 22. Further, the height of the liquid bottle 21 from the opening 22 to the bottom surface 25 may vary depending on the capacity, and the resist feed tube 3 may be suitably designed depending upon said height. By way of example, the cap body 52 and the upper cap 71 may be used as a common component regardless of the capacity of the liquid bottle 21.

Figure 6:
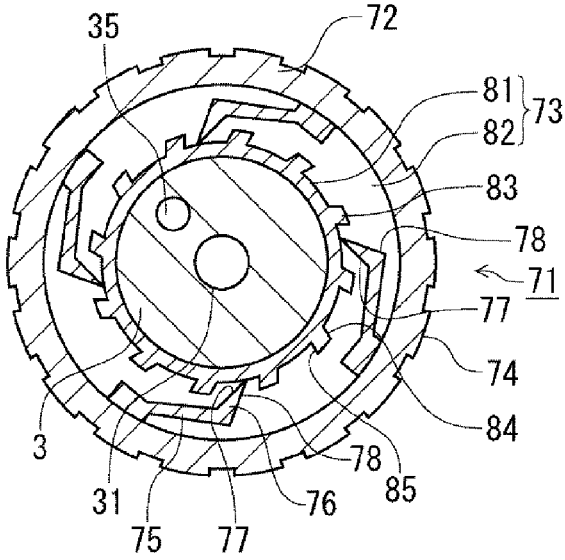
FIG. 6 is a cross-sectional plan view of an upper cap constituting the resist feed mechanism.

The upper cap 71 includes a handle 72 (operating rotator) and an outer cylinder 73. The handle 72 has a flat ring-shaped member encircling the resist feed tube 3. The handle 72 is provided coaxially with the inner cylinder 53. An upper inner periphery of the handle 72 is inlaid between the flanges 28, 29 of the resist feed tube 3. Further, an outer periphery of the handle 72 is bent downwardly to form an annular side wall 74. FIG. 6 is a sectional view taken along the line VI-VI of FIG. 5. An inner periphery of the side wall 71 is formed with elastic arms 75 that extend toward the center of the handle 72. A claw 76 protruding toward the center of the handle 72 is provided in a leading end of each arm 75. Engaging surfaces 77, 78 are formed in one side and the opposite side of the claw 76 in a circumferential direction of the handle 72, respectively. While four arms 75 are shown in FIG. 6, the number of the arms should not be limited thereto. Alternatively, the number of the arms may be eight.

The outer cylinder 73 (movable cylinder) is provided coaxially with the inner cylinder 53. The outer cylinder 73 includes cylinders 81, 82 vertically adjoined to each other. The cylinder 82 is configured to have an outer diameter greater than that of the cylinder 81. The side wall 74 of the handle 72 encircles the cylinder 81. An upper edge of the cylinder 81 projects inwardly to be fitted between the flanges 38, 39. Since the flanges 38, 39 sandwich both the upper edge of the cylinder 81 and the inner edge of the handle 72 therebetween as described above, the height of the resist feed tube 3 is fixed with respect to the height of the upper cap 71. Teeth 83 that are arranged with a suitable spacing in a circumferential direction project from the outer periphery of the cylinder 81 outwardly of the cylinder 81. The tooth 83 includes engaging surfaces 84, 85 at one side and the opposite side in a circumferential direction, respectively.

A thread is formed on an inner periphery 86 of the cylinder 82. The thread is screw-engaged to the thread 56 of the inner cylinder 53. Further, as the outer cylinder 73 is rotated about the axis, the outer cylinder 73 is advanced or retracted in the axial direction relative to the cap body 52. This changes the height position of the resist feed tube 3 in a longitudinal direction of the resist feed tube 3.

Figure 7A:
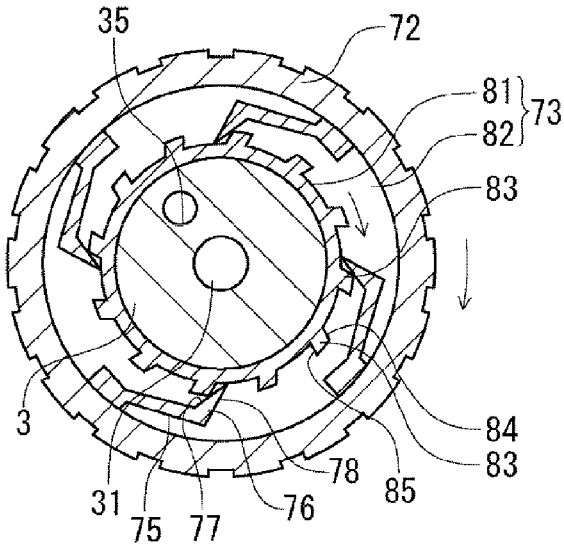
FIGS. 7A to 7C are illustrative views showing rotation of the upper cap.

Descriptions will be continued as to the operations of the bottle cap 5. When rotating the handle 72 in a clockwise direction (when viewed from above) and when the lower end of the resist feed tube 3 is apart from the bottom surface 25 of the liquid bottle 21, as shown in FIG. 7A, the engaging surface 77 of the claw 76 and the engaging surface 84 of the tooth are engaged to each other and thus the outer cylinder 73 is also rotated in a clockwise direction along with the rotation of the handle 72. As a result, the upper cap 71 is moved downwardly relative to the lower cap 51 in the longitudinal direction of the resist feed tube 3. As described above, the position of the upper cap 71 is fixed with respect to the height of the resist feed tube 3. Thus, if the upper cap 71 is moved downwardly relative to the lower cap 51, then the resist feed tube 3 is also moved downwardly relative to the lower cap 51.

Figure 7B:
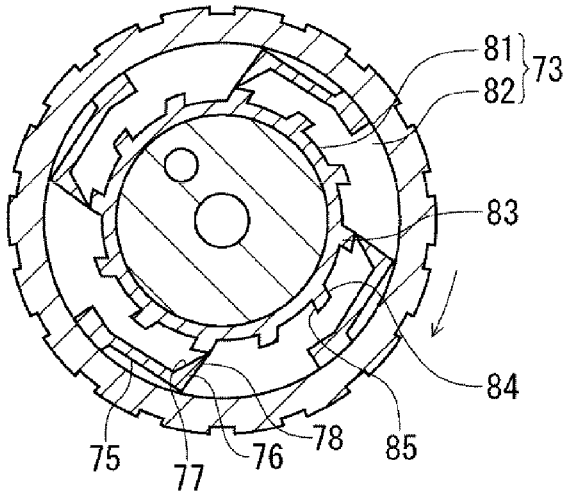

Subsequently, the lower end of the resist feed tube 3 is brought into abutment with the bottom surface 25 of the liquid bottle 21. Then, a torque necessary for rotating the outer cylinder 73 increases and, as shown in FIG. 7B, the leading end of the arm 75 flexes outwardly and the claw 76 rides on the tooth 83, thus releasing the engagement between the engaging surface 77 and the engaging surface 84. If the handle 72 is further rotated and the claw 76 goes over the tooth 83, then the arm 75 reverts to its original shape due to its restoring force. If the handle 72 is still further rotated and the claw 76 abuts against the tooth 83 again, similar to the foregoing, the arm 75 flexes and the claw 76 rides on the tooth 83.

Due to the disengagement between the claw 76 and the tooth 83 as described above, the handle 72 is allowed to idle and the outer cylinder 73 does not rotate. As a result, the resist feed tube 3 becomes stationary with the lower end thereof in contact with the bottom surface 25 of the liquid bottle 21. As such, the bottle cap 5 stops the rotation of the outer cylinder 73 when the torque on the outer cylinder 73 becomes greater than a predetermined value. That is, the bottle cap 5 is configured as a cap with a so-called torque limiter.

Figure 7C:
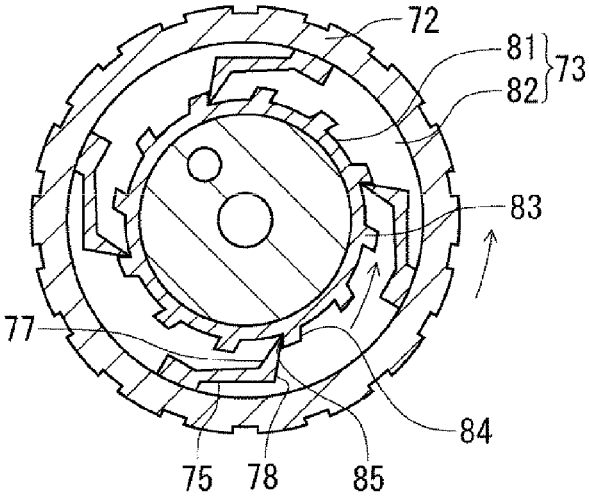

Further, when the handle 72 is rotated in a counterclockwise direction (when viewed from above), the engaging surface 78 of the claw 76 and the engaging surface 85 of the tooth 83 are engaged to each other and the outer cylinder 73 is also rotated in a counterclockwise direction along with the rotation of the handle 72, as shown in FIG. 7C. As a result, the upper cap 71 is raised relative to the lower cap 51 and thus the resist feed tube 3 is also raised relative to the lower cap 51. The claws 76 and the teeth 83 are configured such that the disengagement between the claws 76 and the teeth 83 is not caused when the resist feed tube 3 is raised as described above.

Figure 8:
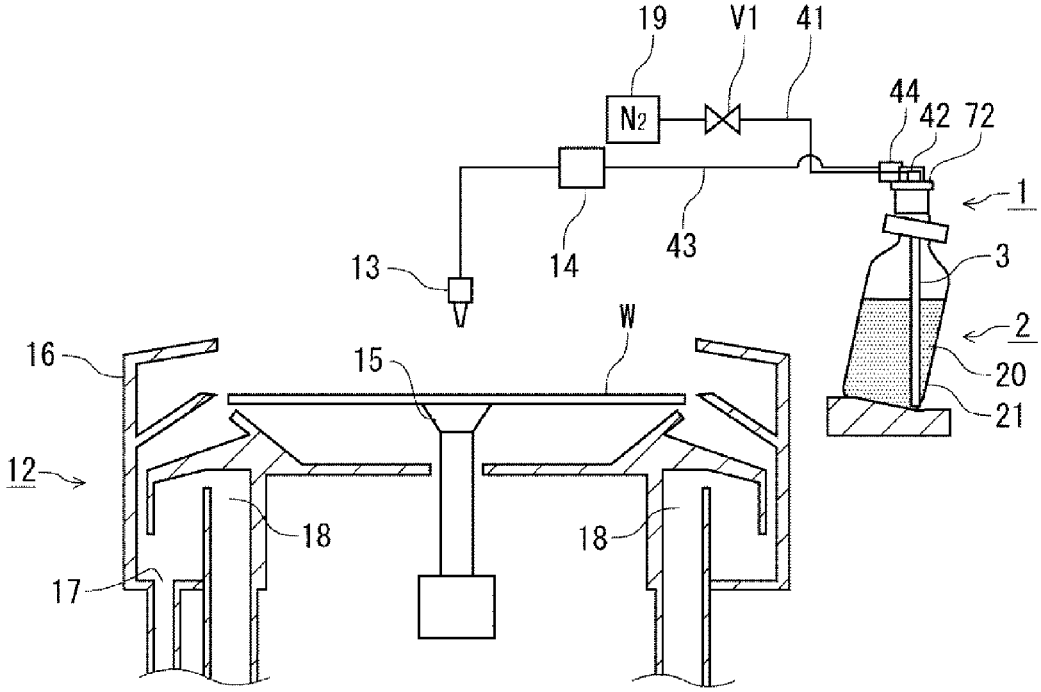
FIG. 8 is a schematic diagram showing a resist coating apparatus to which the pressurized resist feed mechanism is applied.

FIG. 8 shows an example configuration of a resist coating apparatus 12 to which the above-described pressurized resist feed container 2 is applicable. A resist feeding nozzle 13 is provided downstream of the pipe 43. Further, a flow rate controller 14 including a mass flow controller is interposed in the pipe 43 to control the flow rate of the resist 20. Reference numeral 15 in FIG. 8 indicates a spin chuck that holds a center of a back side of the wafer W to horizontally maintain the wafer and rotates the wafer W about a perpendicular axis to spin-coat the wafer with the fed resist. A cup 16 for suppressing scattering of the resist is provided near the spin chuck 15. The cup 16 includes a liquid draining port 17 and an exhaust port 18.

When a valve V1 interposed in the $N_2$ gas feed pipe 43 is opened, the $N_2$ gas is supplied from the $N_2$ gas supply source 19 to the liquid bottle 21, thus pressurizing the interior of the liquid bottle 21. Then, the resist 20 flows into the resist flow passage 31 of the resist feed tube 3 and then is discharged from the resist feeding nozzle 13 to the center of the wafer W. The discharged resist 20 is spread toward a periphery of the wafer W under a centrifugal force and thus the entire surface of the wafer W is coated with the resist 20.

Figure 9A:
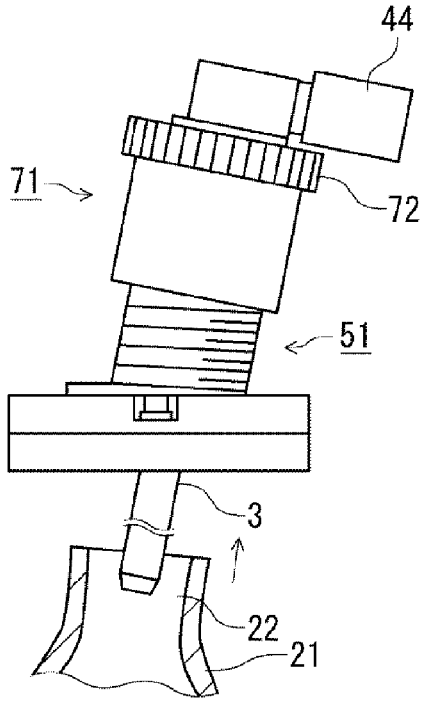
FIGS. 9A and 9B are process diagrams showing attaching the resist feed mechanism to a liquid bottle.
Figure 9B:
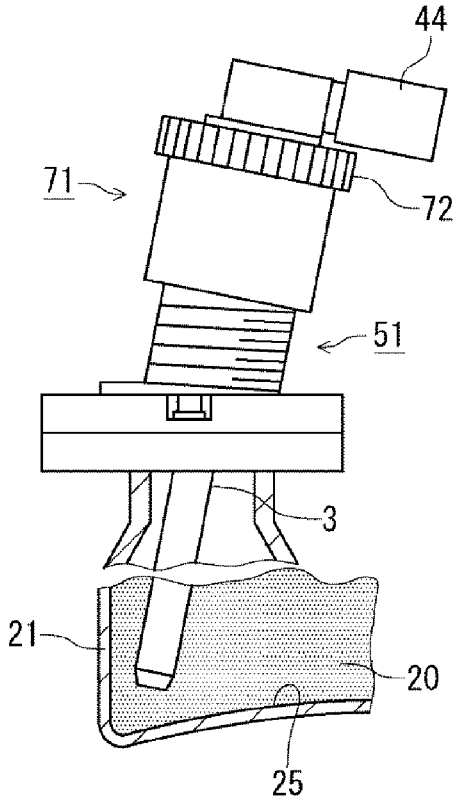

Next, descriptions will be provided as to procedures with which a user attaches the resist feed mechanism 1 to the liquid bottle 21 and performs the positional adjustment of the resist feed tube 3 in a clean room. First, the upper cap 71 is adjusted and set such that it is positioned relatively upward relative to the lower cap 51. The liquid bottle 21 with the resist 20 stored therein is prepared and the resist feed tube 3 is inserted into the liquid bottle 21 from the opening 22 of the liquid bottle 21 (see FIG. 9A). The thread in the outer periphery 24 of the opening 22 and the thread in the inner periphery 64 of the lower ring 62 are screw-engaged to each other, thereby anchoring the resist feed mechanism 1 to the liquid bottle 21 and sealing up the interior of the liquid bottle 21 (see FIG. 9B). In this case, the lower end of the resist feed tube 3 is up apart from the bottom surface 25 of the liquid bottle 21.

Figure 10A:
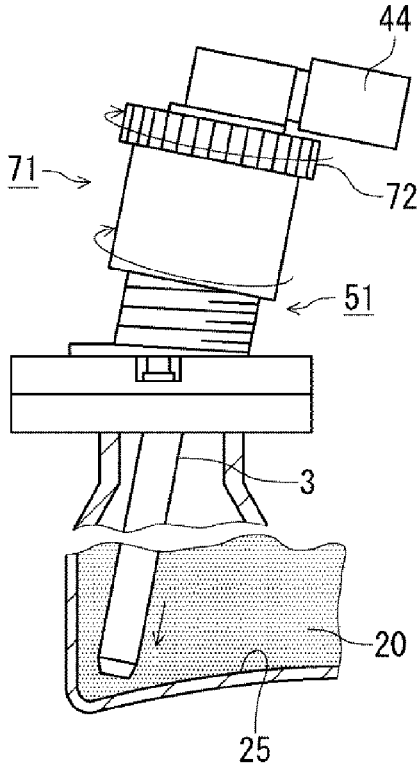
FIGS. 10A and 10B are process diagrams showing attaching the resist feed mechanism to a liquid bottle.
Figure 10B:
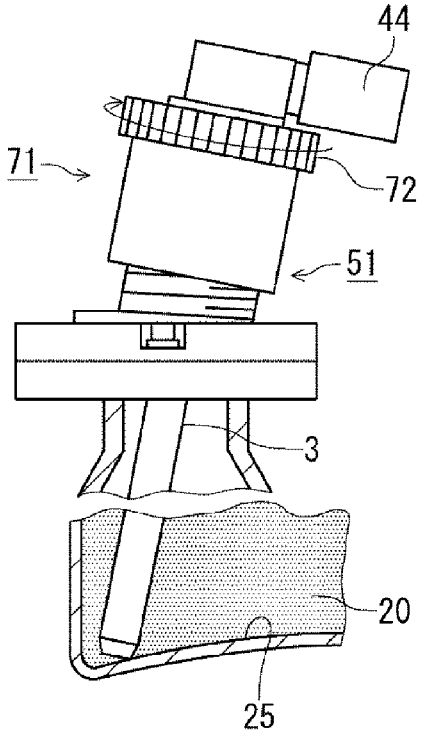

Subsequently, to lower the height of the resist feed tube 3, the user rotates the handle 72 as described above. Then, as shown in FIG. 7A, the outer cylinder 73 is rotated in the same direction as the handle 72. As a result, the vertical position of the upper cap 71 is lowered and the vertical position of the resist feed tube 3 is also lowered accordingly (see FIG. 10A). If the lower end of the resist feed tube 3 is brought into abutment with the bottom surface of the liquid bottle 21, then the handle 72 is allowed to idle as shown in FIG. 7B and lowering the resist feed tube 3 stops (see FIG. 10B). If the handle 72 idles as such, then the user stops rotating the handle 72. Subsequently, the user places the liquid bottle 21 in a predetermined location in the clean room such that the resist feed tube 3 is perpendicularly oriented.

In the event of replacing the liquid bottle 21, the resist feed mechanism 1 is removed from the liquid bottle 21 in procedures reverse to the foregoing attachment. Specifically, the handle 72 is rotated in a direction opposite to the foregoing lowering of the position of the resist feed tube 3. As shown in FIG. 7C, the outer cylinder 73 is also rotated in the same direction as the rotation of the handle 72 and thereby the vertical position of the upper cap 71 is raised relative to the lower cap 51. Thereafter, another liquid bottle 21 with a new resist 20 contained therein is prepared and the resist feed mechanism 1 is attached again as described above.

According to the resist feed mechanism 1 as described above, if the handle 72 is rotated in order to lower the height of the resist feed tube 3, the lower end of the resist feed tube 3 is brought into abutment with the bottom surface 25 of the liquid bottle 21. Further, if the torque on the outer cylinder 73 fixed in height with respect to the resist feed tube 3 increases, the claws 76 provided in the handle 72 and the teeth 83 provided in the outer cylinder 73 are disengaged from each other, thus allowing the handle 72 to idle. Thus, even if the vertical position of the lower end of the resist feed tube 3 cannot be seen when viewed from outside the liquid bottle 21, the resist feed tube 3 can be fixed with the lower end thereof in abutment with the bottom surface 25 of the liquid bottle 21 regardless of a user's skill or experiences. Accordingly, it is possible to reduce the remaining amount of the resist in the liquid bottle 21 and thus to prevent an increase in process cost.

Further, according to the resist feed mechanism 1, a mere single operation of rotating the handle 72 can achieve the height adjustment for the resist feed tube 3 as well as the fixation of the resist feed tube 3 to the bottle cap 5. Thus, compared with the case of fixing the position of the resist feed tube 3 after the positional adjustment of the resist feed tube 3 as explained in the BACKGROUND section, the number of the process steps to be executed by the user can be decreased. This can reduce the burden on the user and achieve a reduction in work time.

Further, since the $N_2$ gas flow passage 36 is formed in the resist feed tube 3, the resist feed mechanism 1 can have fewer joints, when compared with a structure having a $N_2$ gas feed tube that is provided separately from the resist feed tube 3 and has a downstream end situated in the liquid bottle 21. Accordingly, the resist feed mechanism 1 can have a simpler structure and more securely prevent the process liquid or gas in the liquid bottle 21 from leaking.

The foregoing embodiment uses the resist 20 as the process liquid. In other embodiments, other liquids such as thinner, HMDS (hexamethyldisilazane), etc. may be used as the process liquid. For example, to improve wet spreadability of a resist, the thinner is fed to the wafer prior to the resist 20. The HDMS hydrophobizes a surface of the wafer to increase adhesion of a resist.

Further, as to the process atmosphere wherein the liquid bottle 21 is situated, the process liquid, instead of the liquid bottle 21, may shade the lower end of the process liquid feed tube 3 and thus the lower end may be invisible. The mechanism in accordance with the embodiments is effective to such a case since the vertical position of the lower end of the process liquid feed tube 3 can be fixed with the lower end in abutment with the bottom surface 25.

Figure 11:
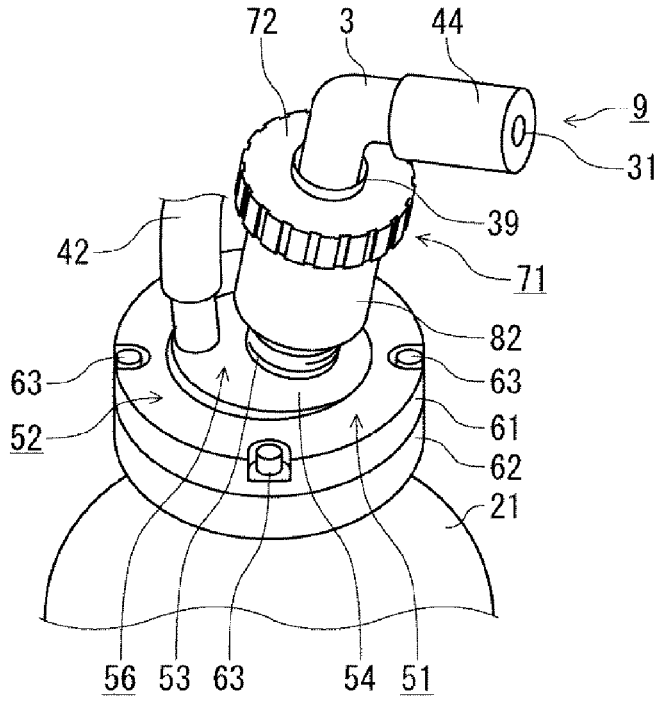
FIG. 11 is a perspective view of a resist feed mechanism in accordance with another embodiment.
Figure 12:
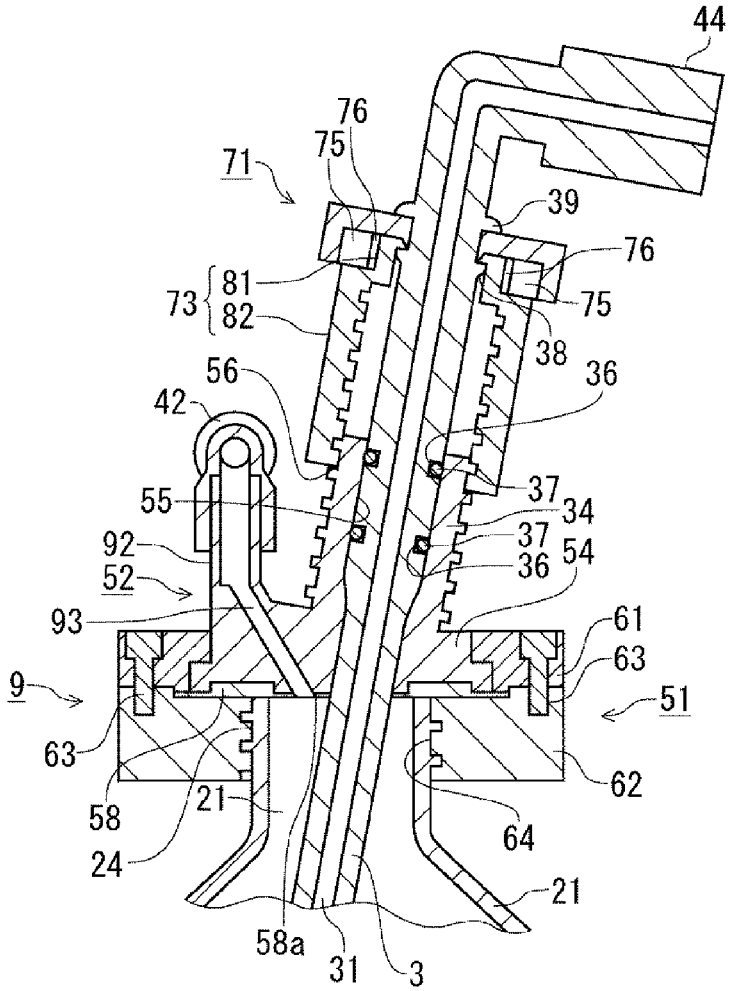
FIG. 12 is a longitudinally-sectional side view of the resist feed mechanism in accordance with another embodiment.

Next, descriptions will be made as to a resist feed mechanism 9 according to a variation embodiment of the resist feed mechanism 1 with reference to FIG. 11 showing a perspective view thereof and FIG. 12 showing a longitudinally-sectional side view of FIG. 11, as focusing on the differences between the resist feed mechanism 9 and the resist feed mechanism 1. Like reference numerals are given to like parts identical to those of the resist feed mechanism 1 and descriptions thereon will be omitted. In the resist feed mechanism 9, the $N_2$ gas flow passage 35 is not formed in the resist feed tube 3. A projection portion 92 is provided above the supporter 54 of the lower cap 51. A $N_2$ gas flow passage 93 is provided from an upper end of the projection portion 92 to the lower end of the supporter 54.

A lower end of the flow passage 93 is open toward the opening 22 of the liquid bottle 21. Reference numeral 58*a* in FIG. 12 indicates an opening formed in the sealing member 58 to correspond to the flow passage 93. A $N_2$ gas feed port 42 is provided in the projection portion 92. Although the $N_2$ gas flow passage 93 is configured as such, the resist feed mechanism 9 can have few joints, when compared with a case wherein the $N_2$ gas feed tube for feeding the $N_2$ gas into the liquid bottle 21 is provided separately in the lower cap 51.

Figure 13:
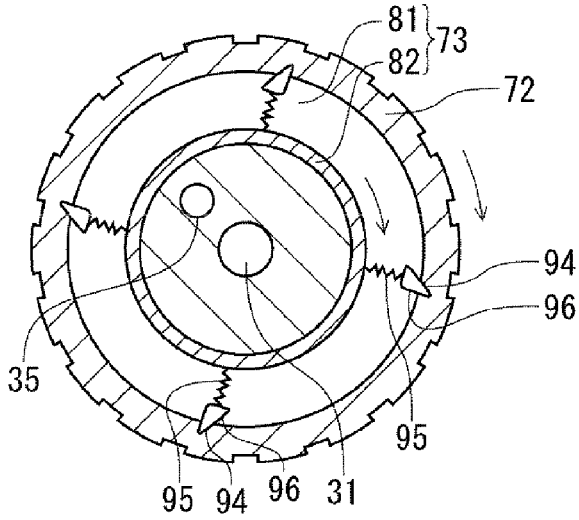
FIG. 13 is a cross-sectional plan view of the resist feed mechanism in accordance with another embodiment.

Further, a structure for the engagement between the handle 72 and the cylinder 81 is not limited to the above-described example. In an example shown in FIG. 13, recesses 94 (engaged portion) are provided on the outer periphery of the cylinder 81. Further, engaging pieces 96 (engaging portion) are provided, which are biased by a spring 95 from the inner periphery of the handle 72 toward the center. When lowering the vertical position of the resist feed tube 3 from the state where the resist feed tube 3 is spaced apart from the liquid bottle 21, the engaging pieces 96 and the recesses 94 are engaged to each other as shown in FIG. 13 and thus the cylinder 81 and the handle 72 are rotated together. If the lower end of the resist feed tube 3 is brought into abutment with a lower end of the liquid bottle 21, the engaging pieces 96 are separated from the recesses 94, thus releasing the engagement therebetween.

In the foregoing embodiments, the upper cap 71 that constitutes the movable cylinder moving together with the resist feed tube 3 is located outside the lower cap 51 that constitutes a fixed cylinder fixed to the liquid bottle 21. In other embodiment, the upper cap 71 may be located outside the lower cap 51. That is, the cylinder 82 of the upper cap 71 may be located inside the inner cylinder 53 of the lower cap 51. Further, a thread may be formed for screw-engagement between the outer periphery of the cylinder 82 and the inner periphery of the inner cylinder 53.

Figure 14:
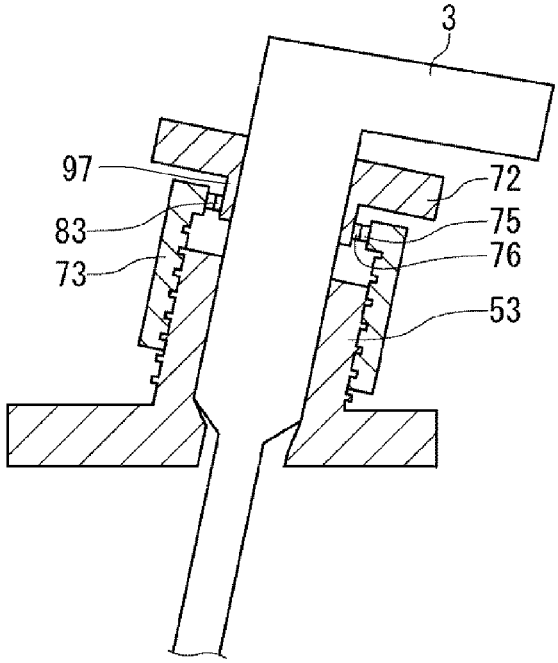
FIG. 14 is a schematic longitudinally-sectional side view of a resist feed mechanism in accordance with yet another embodiment.
Figure 15:
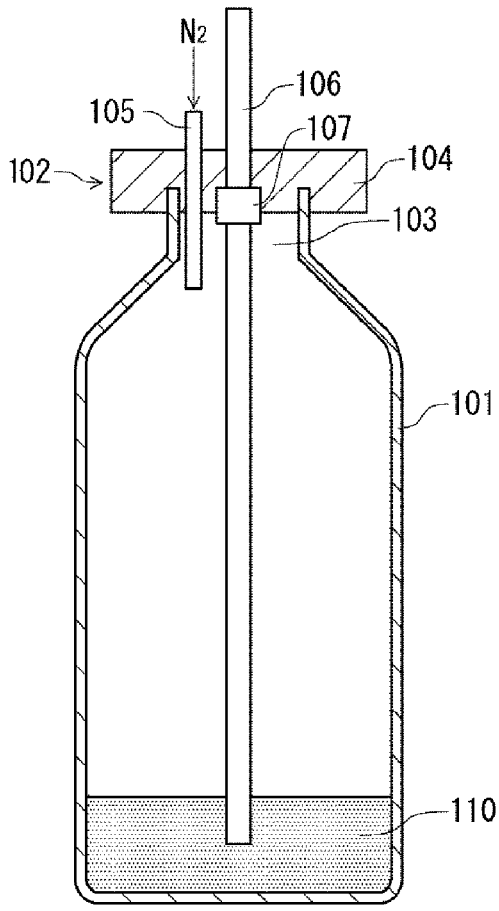
FIG. 15 (PRIOR ART)
FIG. 15 is a longitudinally-sectional side view of a prior art process liquid feed mechanism.

Further, the location of the handle 72 should not be limited to the outside of the outer cylinder 73. FIG. 14 schematically shows a relative position between the handle 72 and the outer cylinder 73. The inner edge of the handle 72 projects downward to form a ring-shaped projection 97 that enters into the inside of the outer cylinder 73. For example, the teeth 83 are provided on an outer peripheral surface of the projection 97, while the claws 76 and the arms 75 are provided on the inner peripheral surface of the outer cylinder 73. Further, similar to the foregoing embodiments, if the handle 72 is rotated and the torque on the outer cylinder 73 increases, then the engagement between the claws 76 and the teeth 83 is released.

Further, according to the foregoing embodiments, when the torque on the outer cylinder 73 increases, the arms 75 deform to release the engagement to the claws 76 and teeth 83. In other embodiment, instead of providing such arms 75, the claws 76 and the teeth 83 may be configured to have elasticity. In such a case, when the torque increases, such claws 76 or teeth 83 may be deformed to release the engagement therebetween.

According to the embodiments disclosed herein, as the operating rotator is rotated, the movable cylinder of the process liquid feed tube with a position fixed in an axial direction is allowed to be rotated. Further, the engaging portion and the engaged portions are provided in the movable cylinder and the ring-shaped portion respectively such that the disengagement therebetween is caused when the torque applied on the movable cylinder increases. Accordingly, although the container is lightproof, the lower end of the process liquid feed tube can be brought into abutment with the bottom surface of the container body. This can prevent the process liquid from remaining in the container body.

What is claimed is:

1. A process liquid feed mechanism for feeding a process liquid stored in a container, the container including a container body and a lid closing a top opening of the container body, the process liquid feed mechanism comprising:

a fixed cylinder with a thread formed on a peripheral surface, the fixed cylinder projecting from the lid upwardly of the container body;

a movable cylinder provided coaxially with the fixed cylinder and screw-engaged to the fixed cylinder;

a process liquid feed tube passing through the lid, the fixed cylinder and the movable cylinder so as to be axially movable relative to the fixed cylinder, the process liquid feed tube being fixed in an axial position relative to the movable cylinder;

an operating rotator including an annular portion provided coaxially with the movable cylinder; and an engaging portion and an engaged portion provided in the movable cylinder and the annular portion respectively, the engaging portion and the engaged portion being configured to rotate the movable cylinder through engagement therebetween when the operating rotator is rotated and to release the engagement therebetween as a torque applied to the movable cylinder increases, wherein when a rotation of the operating rotator brings a lower end of the process liquid feed tube into abutment with a bottom of the container body, the engaging portion and the engaged portion release the engagement therebetween, thus idling the operating rotator; and wherein the longitudinal axes of the process liquid feed tube, the fixed cylinder and the movable cylinder are inclined relative to the longitudinal axis of the container body and the lower end of the process liquid feed tube abuts with a peripheral portion of the bottom of the container body.

2. The process liquid feed mechanism of claim 1, wherein the container is lightproof.

3. The process liquid feed mechanism of claim 1, wherein the process liquid is lightproof.

4. The process liquid feed mechanism of claim 1, wherein the fixed cylinder is located inside the movable cylinder.

5. The process liquid feed mechanism of claim 1, wherein the annular portion is provided outside the movable cylinder to encircle the movable cylinder.

6. The process liquid feed mechanism of claim 1, wherein the process liquid is pressure-sent by a pressurizing gas.

7. The process liquid feed mechanism of claim 6, wherein a feed passage for the pressurizing gas separated from a flow passage for the process liquid is provided in the process liquid feed tube.

8. The process liquid feed mechanism of claim 6, wherein the fixed cylinder is located inside the movable cylinder.

9. The process liquid feed mechanism of claim 6, wherein the annular portion is provided outside the movable cylinder to encircle the movable cylinder.

* * * * *